US007055711B2

(12) United States Patent
Sasaki et al.

(10) Patent No.: US 7,055,711 B2
(45) Date of Patent: Jun. 6, 2006

(54) BOTTLE-SHAPED CONTAINER MADE OF SYNTHETIC RESIN

(75) Inventors: Masaaki Sasaki, Matsudo (JP); Takao Iizuka, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 77 days.

(21) Appl. No.: 10/500,039

(22) PCT Filed: Dec. 27, 2002

(86) PCT No.: PCT/JP02/13789

§ 371 (c)(1),
(2), (4) Date: Jun. 23, 2004

(87) PCT Pub. No.: WO03/057571

PCT Pub. Date: Jul. 17, 2003

(65) Prior Publication Data

US 2005/0035082 A1 Feb. 17, 2005

(30) Foreign Application Priority Data

Dec. 28, 2001 (JP) ..... 2001-398853

(51) Int. Cl.
*B65D 1/02* (2006.01)
*B65D 1/42* (2006.01)

(52) U.S. Cl. ..... 215/373; 220/606; 220/608; 220/609

(58) Field of Classification Search ..... 215/371, 215/373, 375; 220/606, 608, 609
See application file for complete search history.

(56) References Cited

U.S. PATENT DOCUMENTS

| | | | | |
|---|---|---|---|---|
| 4,520,936 | A * | 6/1985 | Lyons | 215/375 |
| 5,222,615 | A | 6/1993 | Ota et al. | |
| 5,713,480 | A * | 2/1998 | Petre et al. | 215/373 |

FOREIGN PATENT DOCUMENTS

| | | |
|---|---|---|
| JP | A 62-52033 | 3/1987 |
| JP | A 8-301253 | 11/1996 |
| JP | A 10-146879 | 6/1998 |
| JP | A 10-181734 | 7/1998 |
| JP | A 11-59646 | 3/1999 |
| JP | A 2001-180637 | 7/2001 |

* cited by examiner

*Primary Examiner*—Sue A. Weaver
(74) *Attorney, Agent, or Firm*—Oliff & Berridge, PLC

(57) ABSTRACT

A container has a grounding portion that is free from sink and can prevent sink from occurring, so that it can secure its self-standing ability. The bottle-shaped container made of synthetic resin comprising a neck, a body and a bottom, said bottom including a grounding portion, said bottom being formed at a center thereof with a central bulged section protruding inwardly, said container showing a polygonal transversal cross section, characterized in that a peripheral bottom wall is formed between an outer periphery of the central bulged section and the grounding portion, said peripheral bottom wall forming a step located below the central bulged section and above the grounding portion, and said grounding portion is provided with a recess in a portion formed with an orientation magnification which is smaller than an orientation magnification with which a portion on and along a diagonal line is formed.

6 Claims, 10 Drawing Sheets

BOTTLE-SHAPED CONTAINER MADE OF SYNTHETIC RESIN

BACKGROUND OF THE INVENTION

This invention relates to a bottom structure of a bottle-shaped container made of synthetic resin showing a polygonal transversal cross section. More particularly, it relates to a bottom structure of a bottle-shaped container made of synthetic resin showing a polygonal transversal cross section, and having a central bulged section formed at a center of the bottom and projecting into the container.

A bottle-shaped containers made of synthetic resin such as polyethyleneterephthalate is formed by biaxially-oriented blow-molding a preform. Such containers are widely used for the purpose of containing beverages. The container shows a transversal cross section that may be substantially circular, substantially square, substantially rectangular or of some other profile. The container is required to have a flat grounding portion at a bottom thereof so as to be able to stand on itself.

FIGS. 8–10 illustrate a known container 101 of the type under consideration that has a substantially rectangular transversal cross section. The container 101 comprises a neck 103, a body 105 and a bottom 107 connected to the body 105. The body 105 shows a substantially rectangular transversal cross section, and comprises two longer sides 151, 152 and two shorter sides 153, 154. The bottom 107 comprises a bottom wall 171 having a grounding edge 175 at a peripheral edge thereof, and a bottom peripheral wall 173 standing upwardly from the grounding edge 175. The bottom wall 171 is formed at a center thereof with a central bulged section 177 which is protruded into the container. The bottom wall 171 between the central bulged section 177 and the grounding edge 175 operates as a grounding portion 181. The grounding portion 181 is required to be flat, so that the container can stand on itself.

Meanwhile, in a case of a container showing a substantially circular transversal cross section, a preform is radially oriented to form the container. Since the preform is substantially uniformly oriented in all radial directions, the grounding portion of the container is uniformly oriented to be formed in all radial directions.

However, in a case of a container showing a substantially square or rectangular transversal cross section, an orientation magnification of the preform on a diagonal line is the largest, and an orientation magnification at a portion located off the diagonal line is smaller than that on the diagonal line. Thus, the portion of the container formed with such smaller orientation magnification tends to occur sink, so as to effect a moldability and the self-standing ability of the container.

In the case of the prior art container illustrated in FIGS. 8–10, the orientation magnification of the preform is the largest on the diagonal line L. To the contrary, the orientation magnification of the preform is the smallest on a center line M (passing through a center of each of the longer sides). As a result, sink tends to occur easily at a portion which nucleus is the center line M (shaded portion in FIG. 10), so as to consequently lose the flatness of the grounding portion and damage the self-standing ability of the container. Additionally, the orientation magnification of the preform on a center line N (passing through a center of each of the shorter sides) is smaller than the orientation magnification on the diagonal line L. Thus, sink tends to occur easily at a portion which nucleus is the center line N, compared with a portion on the diagonal line L.

SUMMARY OF THE INVENTION

In view of the above identified circumstances, it is therefore the object of the present invention to prevent sink from occurring, and to provide a container of the type under consideration in which, even if a sink is produced, it does not adversely affect the self-standing ability of the bottle-shaped container.

According to the invention, the above object is achieved by providing a bottle-shaped container made of synthetic resin comprising a neck, a body and a bottom, said bottom including a grounding portion, said bottom being formed at a center thereof with a central bulged section protruding inwardly, said container showing a polygonal transversal cross section, characterized in that a peripheral bottom wall is formed between an outer periphery of the central bulged section and the grounding portion, said peripheral bottom wall forming a step located below the central bulged section and above the grounding portion, and said grounding portion is provided with a recess in a portion formed with an orientation magnification which is smaller than an orientation magnification with which a portion on a diagonal line is formed.

Preferably, said recess has a length in a peripheral direction of the container equal to 20% to 80% of a length of the grounding portion.

If the container shows a substantially rectangular transversal cross section, the recess is formed at a portion which nucleus is a center line passing a center of each longer sides. If the container shows a substantially rectangular transversal cross section, the recess is formed at a portion which nucleus is a center line passing a center of each shorter sides.

If the container shows a substantially square transversal cross section, the recess is formed at a portion which nucleus is a center line passing a center of each of opposed sides.

PREFERRED EMBODIMENTS OF THE INVENTION

Figure 1:
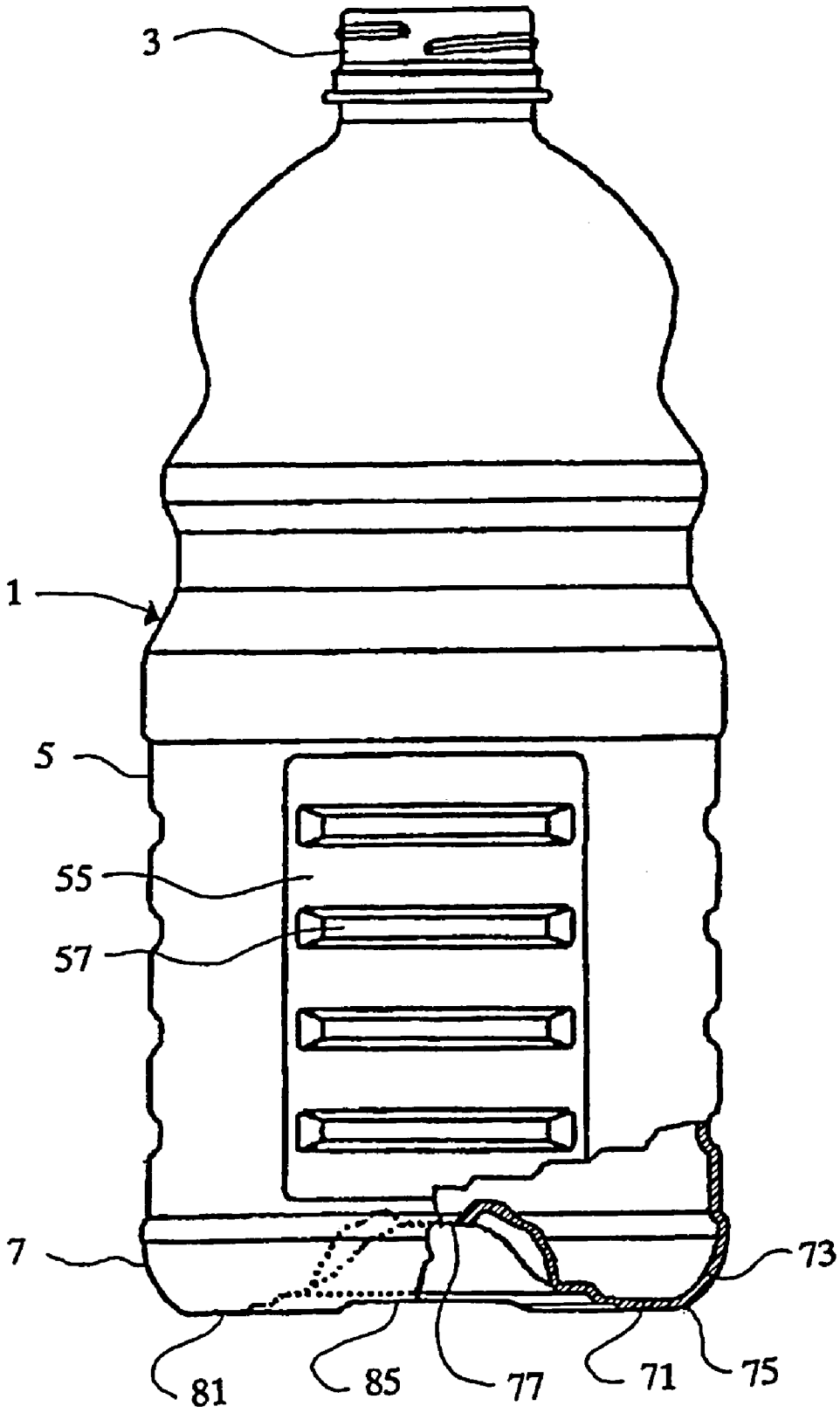
FIG. 1 is a schematic front view of the first embodiment of a container according to the invention, the container being shown partly in cross section.
Figure 2:
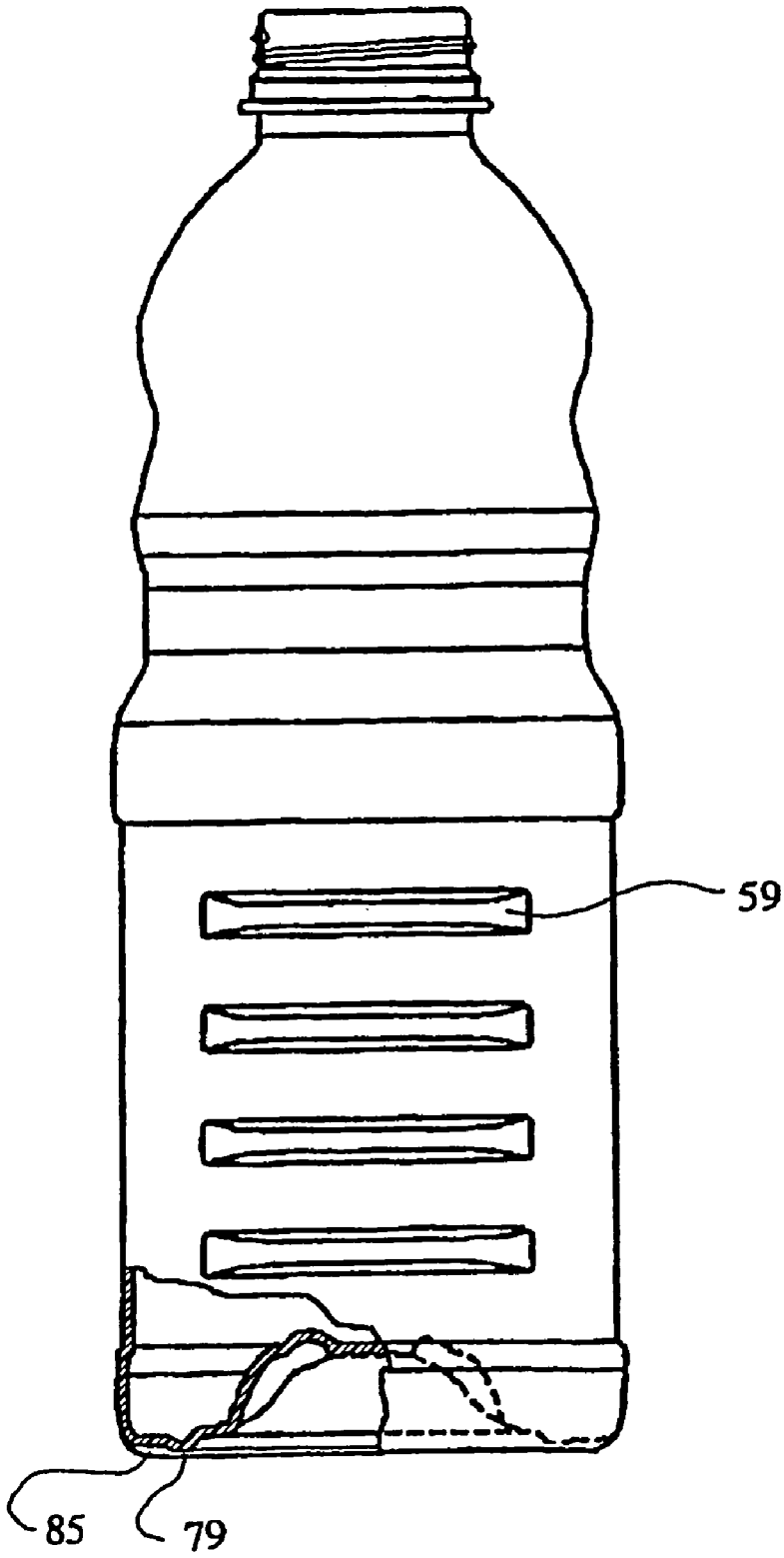
FIG. 2 is a schematic lateral view of the first embodiment of the container according to the invention, the container being shown partly in cross section.

Now, the first embodiment of the invention will be described by referring to FIGS. 1–4 of the accompanying drawings. FIG. 1 shows a partial cross section which passes a center of each of shorter sides. FIG. 2 shows a partial cross section which passes a center of each of longer sides.

Figure 3:
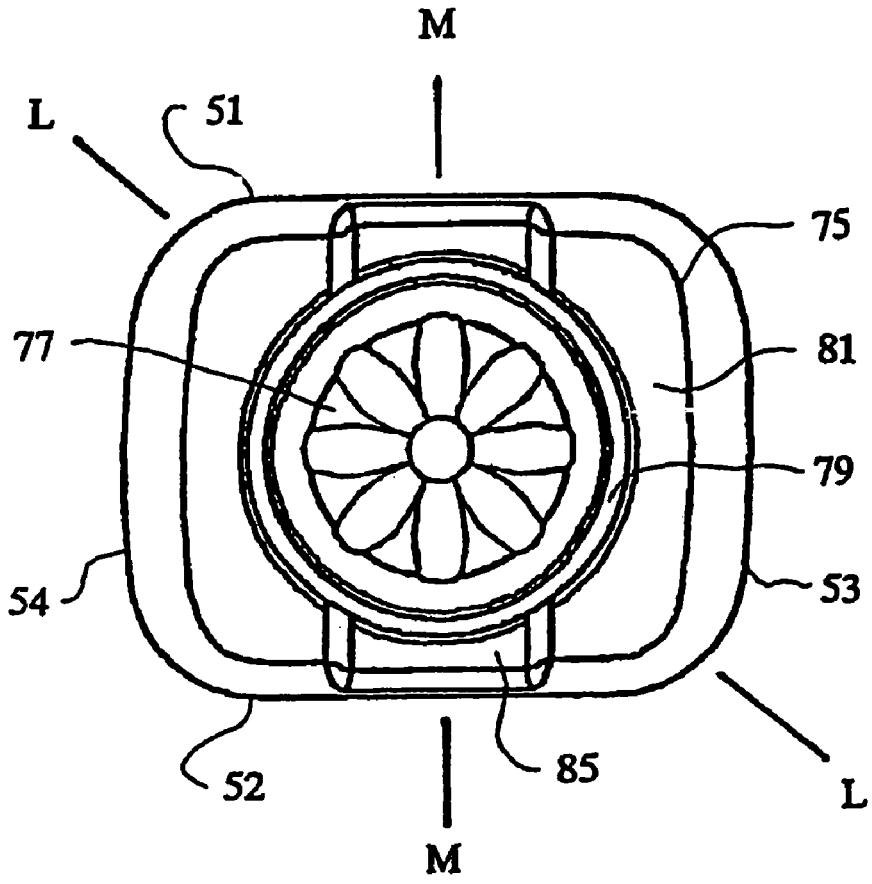
FIG. 3 is a schematic bottom view of the first embodiment of the container according to the invention.
Figure 4:
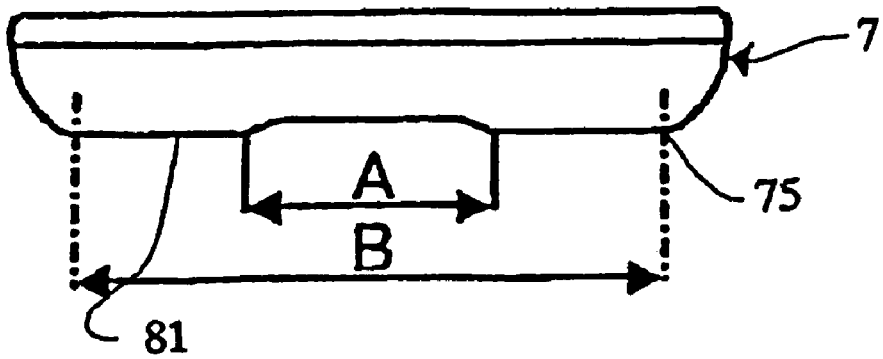
FIG. 4 is a schematic front view of the first embodiment of the invention, showing only the bottom thereof.

A container 1 is made of synthetic resin such as polyethyleneterephthalate, and obtained by biaxially oriented blow-molding a preform also made of the same synthetic resin. The container 1 comprises a neck 3, a body 5, and a bottom 7 connected to the body 5. The body 5 shows a rectangular transversal cross section, and has longer sides 51, 52 and shorter sides 53, 54. The bottom 7 also shows a rectangular transversal cross section as shown in FIG. 3. Each of the longer sides 51, 52 is formed with a recessed panel 55 at a center thereof. Each of the recessed panels 55 is formed with four horizontally extending recessed ribs 57. Each of the shorter sides 53, 54 is formed with four horizontally extending recessed ribs 59 at a center thereof. However, the present invention is by no means limited to such recessed panels 55 and recessed ribs 57, 59.

While the container 1 of the illustrated embodiment shows a rectangular transversal cross section, a container according to the invention is defined to have a polygonal transversal cross section (having three or more corners), and the transversal cross section thereof is not limited to tetragon. However, a container showing a polygonal transversal cross section with a smaller number of corners is more advantageous for the purpose of the present invention, because the cross section comes closer to a circle as number of corners increases. A container according to the invention is not limited to have a polygonal transversal cross section, and may show a square transversal cross section or some other regular polygonal transversal cross section.

The bottom 7 includes a bottom wall 71 having a grounding edge 75 at a peripheral edge thereof, and a bottom peripheral wall 73 standing upwardly from the grounding edge 75. The bottom wall 71 is formed at a center thereof with a bulged or domed section 77 which protrudes into the container. The central bulged section 77 shows a dome shape as is known in the art.

A peripheral bottom wall 79 is formed around the central domed section 77. The peripheral bottom wall 79 is slightly recessed into the container from the bottom wall 71.

The bottom wall 71 between the peripheral bottom wall 79 and the grounding edge 75 operates as grounding portion 81 or grounding surface of the container. In other words, the peripheral bottom wall 79 is formed between the central domed section 77 and the grounding portion 81. The peripheral bottom wall 79 forms a step that is located below the central domed section 77 and above the grounding portion 81.

In the grounding portion 81 of the container illustrated in FIGS. 1–3, a width of the grounding portion 81 is the smallest on a center line M—M which passes a center of each longer sides of the rectangular shape. When forming a container from a preform, an orientation magnification is the smallest on the center line M—M in the bottom of the container. Thus, sink is most likely to occur on the center line M—M in the grounding portion 81.

In the embodiment of FIGS. 1–3, the grounding portion 81 is provided with recesses 85, each of which is concaved into the container, and each of which is formed at a portion where the center line M—M is nucleus.

As described above, the recess 85 is provided in areas where sink tends to occur. Thus, even if sink occurs, sink occurs in the recess 85 and does not occur in the grounding portion 81, so that the container can secure its self-standing ability. In addition, due to the recesses 85, the orientation magnification becomes large, so as to consequently prevent sink from occurring.

Still additionally, the bottom of the container according to the invention is highly undulated due to the formation of the peripheral bottom wall 79, so that the bottom is sufficiently oriented. As a result, sink is prevented from occurring at the bottom. Still additionally, the peripheral bottom wall 79 operates as rib, so as to reinforce the bottom. Thus, even if a sink occurs in the grounding portion 81, distortion of the sink is absorbed by the peripheral bottom wall 79, so that the central bulged section 77 is not distorted, and hence the bottle-shaped container shows a neat and well-balanced profile. Furthermore, if the bottom of the bottle-shaped container is entirely heated in order to heat content stored therein, any thermal deformation is absorbed by the peripheral bottom wall 79.

In the first embodiment, the recess 85 is formed at the portion which nucleus is the center line M—M passing the center of each of the longer sides of the rectangular shape. However, for the purpose of the invention, the recess 85 is formed in a direction where the orientation magnification is smaller than that in a direction of a diagonal. Therefore, the recess 85 may be formed at a portion which nucleus is a center line N—N passing a center of each of the shorter sides of the rectangular shape, as the below-described second embodiment. Both the container of the first embodiment and that of the second embodiment show a rectangular transversal cross section. However, if a container shows a regular polygonal (square) transversal cross section, the recess 85 is formed along a direction where the orientation magnification is smaller than the orientation magnification along the diagonal. More specifically, as illustrated in FIG. l2, the recess is formed at a portion which nucleus is a center line passing a center of each of opposed sides. While each of the recesses 85 is formed to cover the bottom wall 71 and the bottom peripheral wall 73 in the illustrated embodiments, the recess 85 may be formed only in the bottom wall 71 for the purpose of the invention.

Each of the recesses 85 has a depth of 0.5–25.0 mm, preferably 0.5–5.0 mm. In the illustrated embodiments, each of the recesses 85 has a depth of 2.0 mm. If the depth is smaller than 0.5 mm, sink cannot be sufficiently absorbed by the recesses 85. If the depth exceeds 25.0 mm, the effect of absorbing sink is not further improved.

Each of the recesses 85 has a length equal to 20% to 80% of a length of the grounding portion. More specifically, referring to FIG. 4, a length "A" of the recess 85 is equal to 20% to 80% of a length "B" of the grounding portion 81. If the length of the recess 85 is less than 20% of that of the grounding portion 81, sink may occur in not only the recess 85 but also the grounding portion 81. If the length of the recess 85 is more than 80% of that of the grounding portion 81, an area of the grounding portion is too small to affect the self-standing ability of the container. Preferably, the length of the recess 85 is 40–50% of the length of the grounding portion 81.

Figure 5:
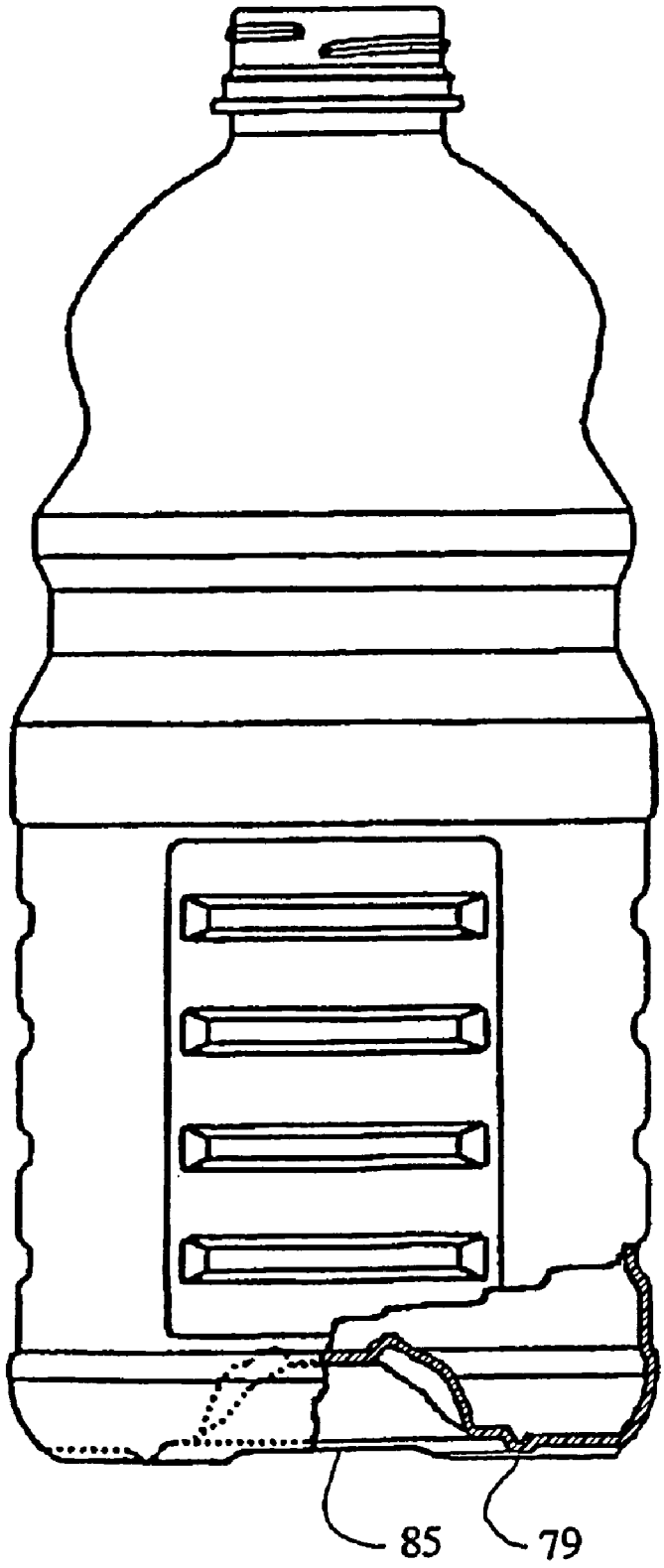
FIG. 5 is a schematic front view of the second embodiment of a container according to the invention, the container being shown partly in cross section.
Figure 6:
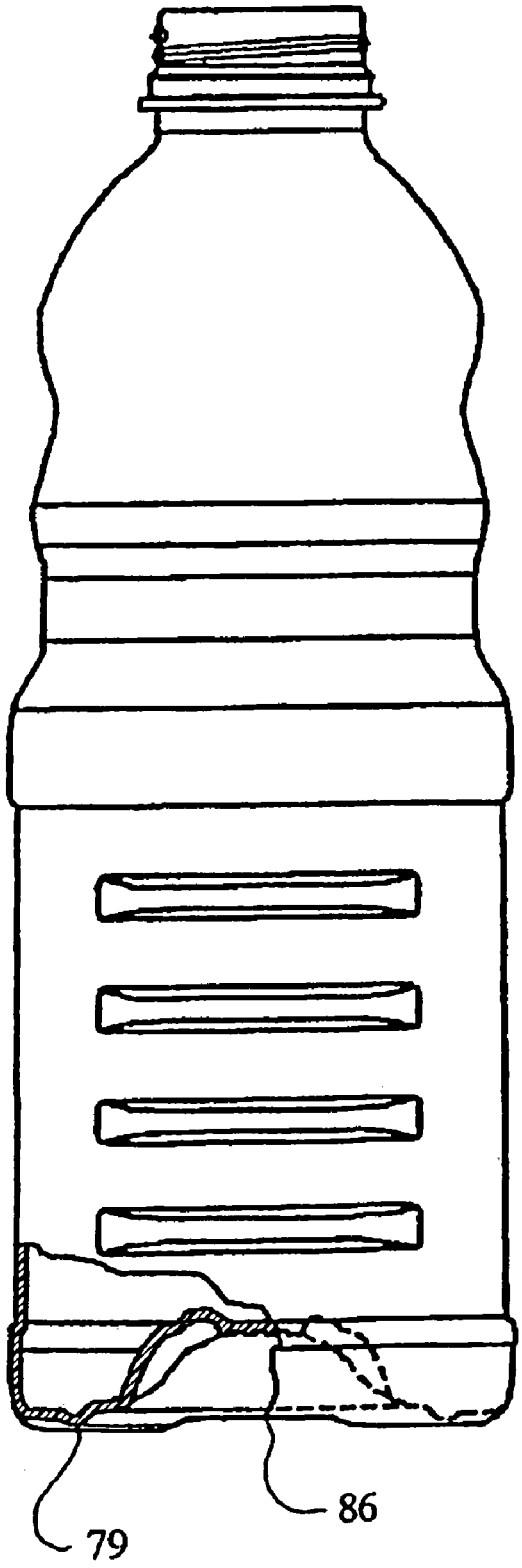
FIG. 6 is a schematic lateral view of the second embodiment of the container according to the invention, the container being shown partly in cross section.
Figure 7:
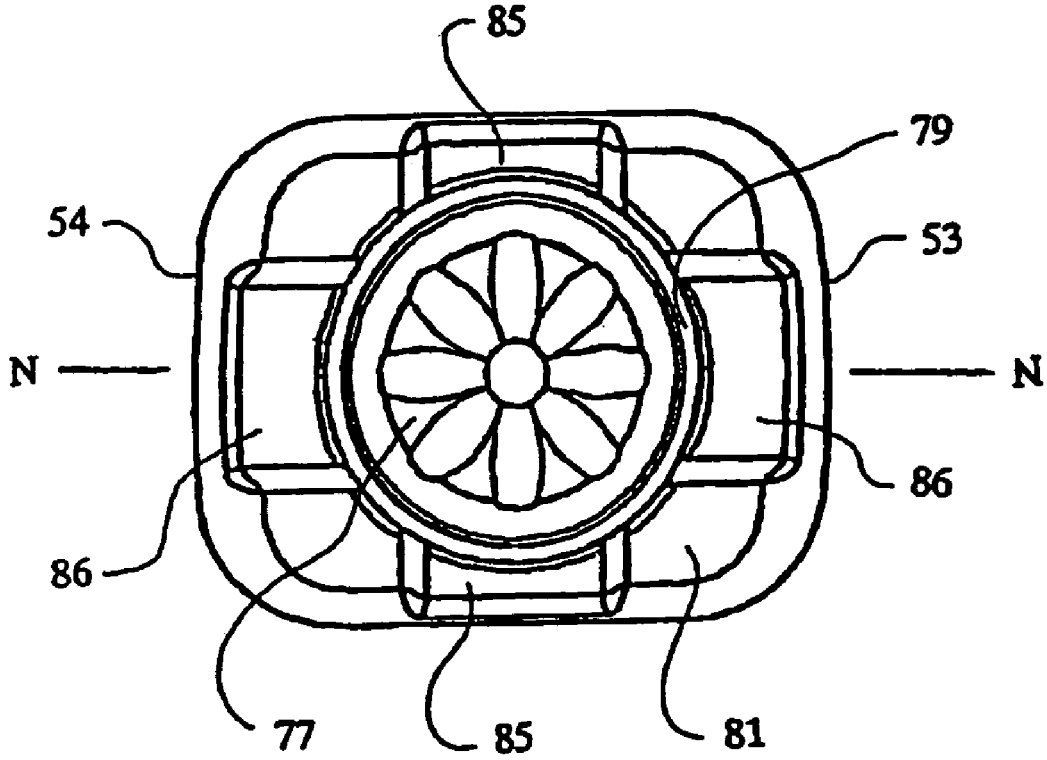
FIG. 7 is a schematic bottom view of the second embodiment of the container according to the invention.
Figure 8:
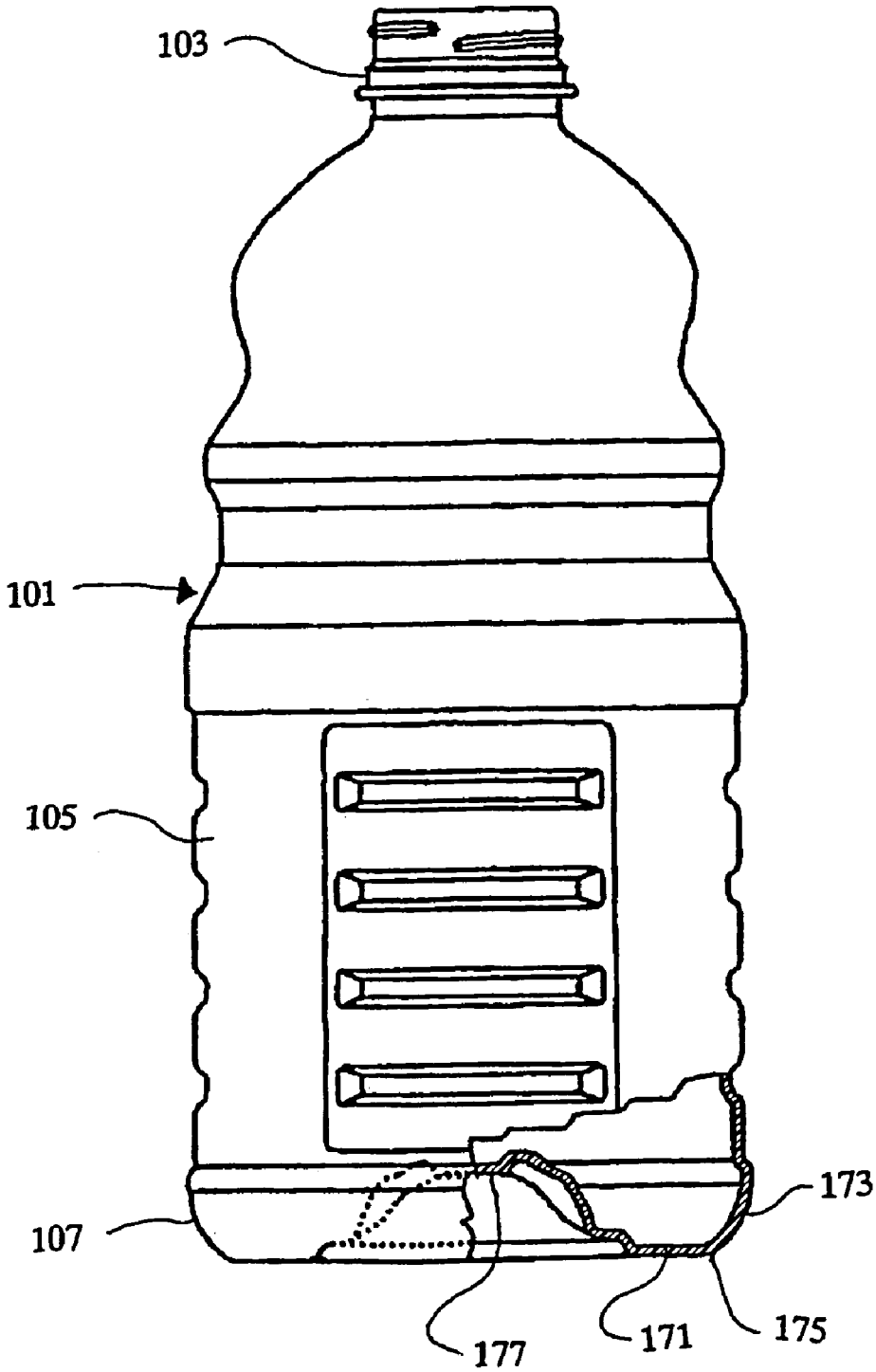
Fig. 8 Prior Art
FIG. 8 is a schematic front view of a prior art container shown partly in cross section.
Figure 9:
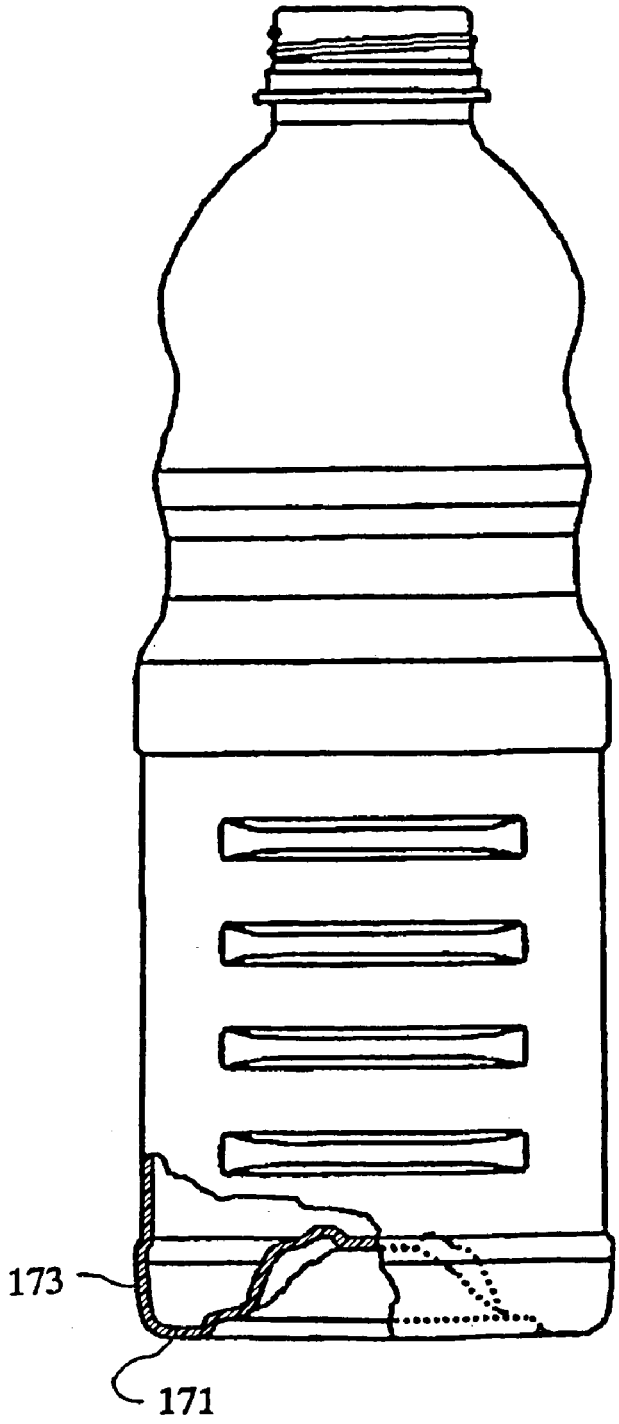
FIG. 9 is a schematic lateral view of the prior art container of FIG. 8 shown partly in cross section.
Figure 10:
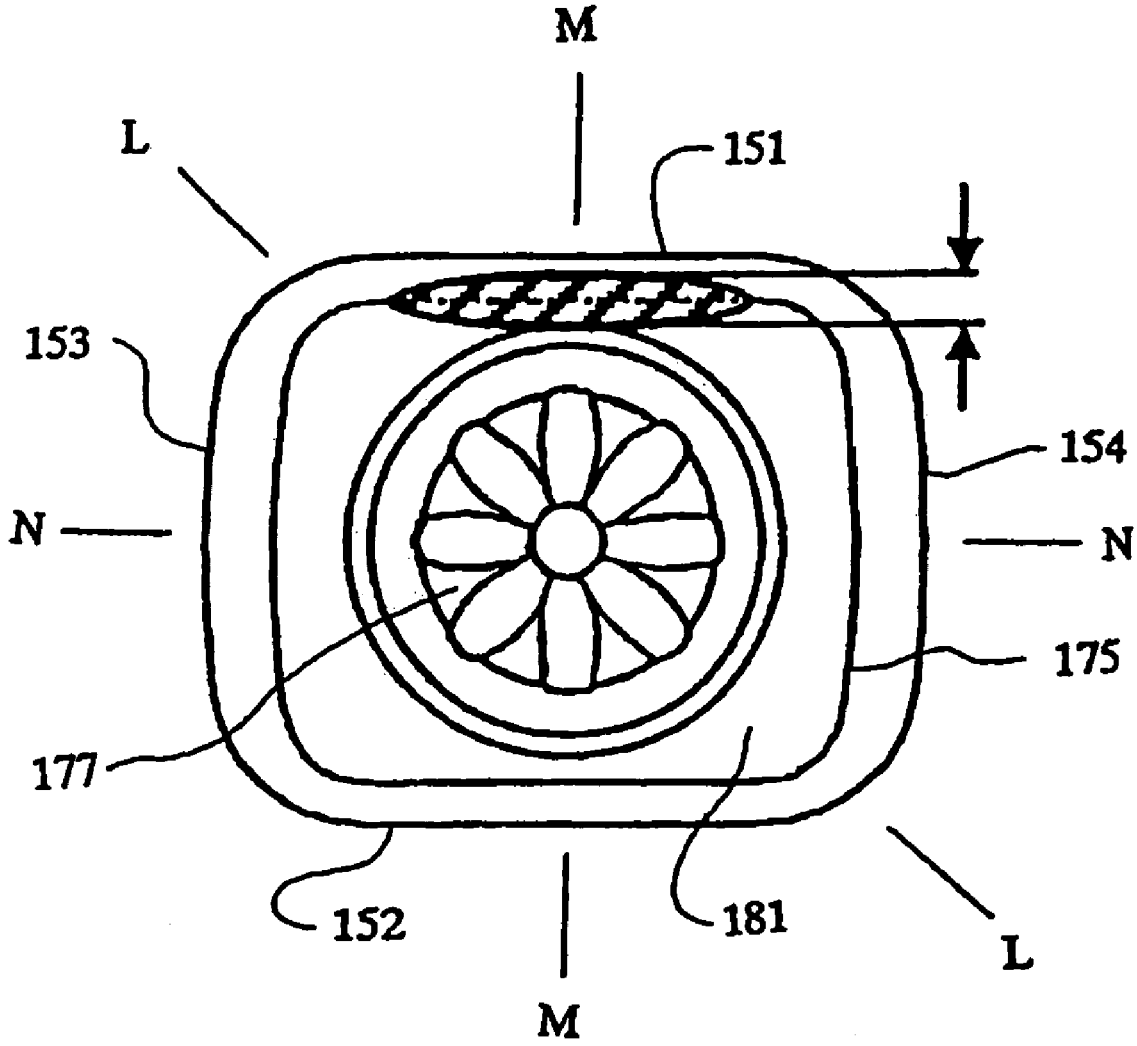
FIG. 10 is a schematic bottom view of the prior art container of FIG. 8.
Figure 11:
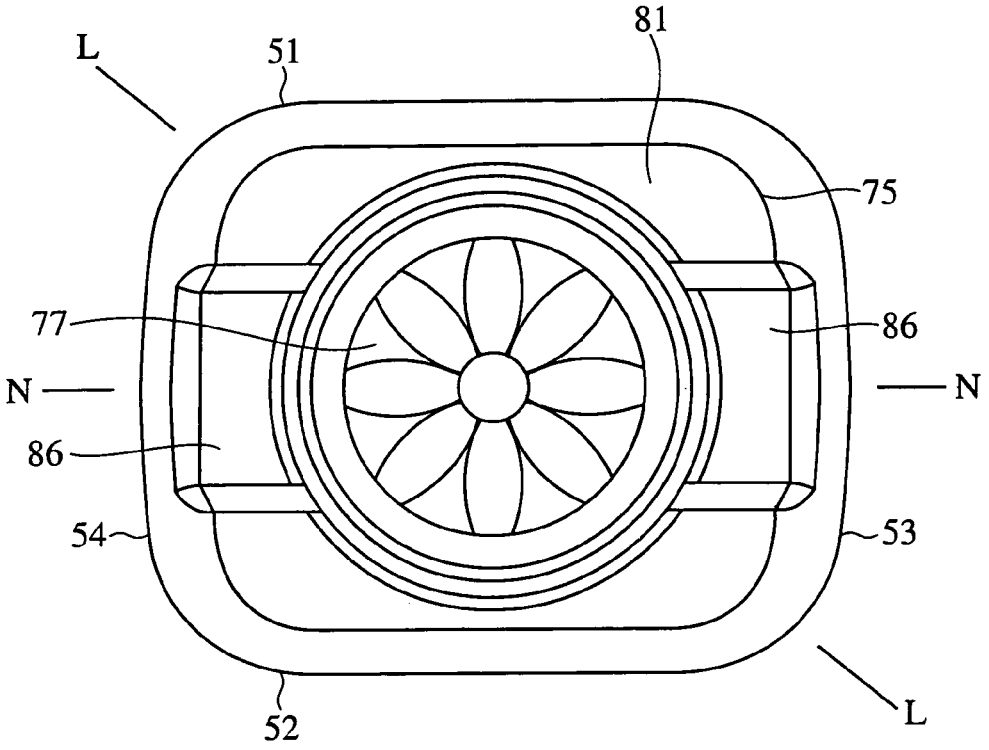
FIG. 11 is a schematic bottom view of the third embodiment of the container.
Figure 12:
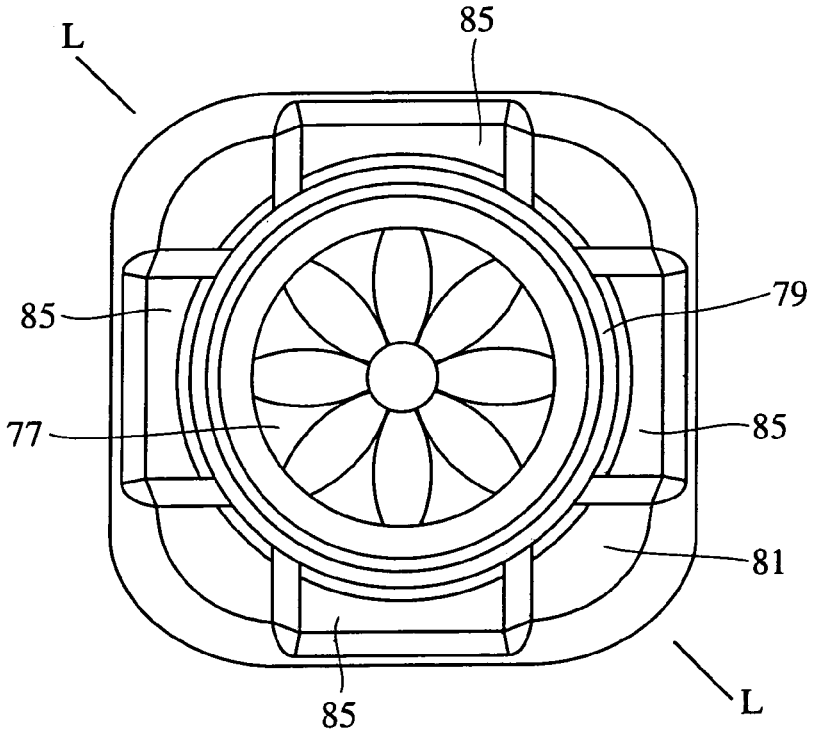
FIG. 12 is a schematic bottom view of the fourth embodiment of the container.

In the second embodiment illustrated in FIGS. 5–7, the container is provided with not only the recesses 85 at the portions each of which nucleus is the center line M—M, but also the recesses 86 at portions each of which nucleus is the center line N—N passing the center of each of the shorter sides of the rectangular shape. Because the orientation magnification on the center line N is smaller than that on the diagonal line L, the portion on and along the center line tends to sink compared to the portion on the diagonal line L. Thus, the recess 86 is provided at a portion which nucleus is the center line N. Like the recess 85, the recess 86 has a depth between 0.5 and 25.0 mm, and has a length equal to 20% to 80% of the length of the grounding portion. Alternatively, as illustrated in FIG. 11, the container is provided with recesses 86 formed only at a portion which nucleus is a center line N—N vassing a center of each of the shorter sides 53, 54 of the rectangular shape, as a third embodiment.

The second embodiment is identical with the first embodiment illustrated in FIGS. 1–3 in terms of configuration and advantages except that it is provided with recesses 86. Therefore, it will not be described here any further.

Note that FIG. 5 shows a partial cross section which passes the center of each of shorter sides of the rectangular shape. FIG. 6 shows a partial cross section which passes the center of each of longer sides of the rectangular shape.

According to the invention, a peripheral bottom wall is formed to surround a central bulged section, and a recess is formed at a portion of a bottom, which portion is formed in an orientation magnification smaller than an orientation magnification on a diagonal. Therefore, even if a sink occurs, it will be found only somewhere in the recess and will not appear in the grounding portion, so that the self-standing ability of the container will be secured. Additionally, since the recess is provided, the orientation magnification of a preform becomes large, so as to consequently prevent sink from occurring. Still additionally, since the peripheral bottom wall is provided, the bottom of the container is sufficiently oriented, to consequently prevent sink from occurring in the bottom. Still additionally, the peripheral bottom wall operates as rib, so as to reinforce the bottom and prevent the central bulged section from being distorted.

When the recess has a length which is equal to 20% to 80% of a length of a grounding portion in a peripheral direction of the container, sink can be sufficiently absorbed, so that the self-standing ability of the container will be secured.

When the container shows a substantially rectangular or square transversal cross section, and when the recess is formed at a portion which nucleus is a center line of the bottom, sink will not occur in the grounding portion, to reliably secure the self-standing ability of the container.

The invention claimed is:

1. A bottle-shaped container mails of synthetic resin comprising:

a neck, a body and a bottom, said bottom including a grounding portion, said bottom being formed at a center thereof with a central bulged section protruding inwardly, said container showing a polygonal transversal cross section, wherein a peripheral bottom wall is formed between an outer periphery of the central bulged section and the grounding portion, said peripheral bottom wall forming a step located below the central bulged section and above the grounding portion, said grounding portion is provided with a recess in a portion formed with an orientation magnification which is smaller than an orientation magnification with which a portion on a diagonal line is formed, and the recess has a depth equal to 0.5 mm to 25.0 mm.

2. The container according to claim 1, wherein said recess has a length in a peripheral direction of the container equal to 20% to 80% of a length of the grounding portion.

3. The container according to claim 2, wherein the container shows a substantially rectangular transversal cross section, and the recess is formed at a portion which nucleus is a center line passing a center of each longer sides.

4. The container according to claim 2, wherein the container shows a substantially rectangular transversal cross section, and the recess is formed at a portion which nucleus is a center line passing a center of each shorter sides.

5. The container according to claim 2, wherein the container shows a substantially square transversal cross section, and the recess is formed at a portion which nucleus is a center line passing a center of each of opposed sides.

6. The container according to claim 3, wherein the container shows a substantially rectangular transversal cross section, and the recess is formed at a portion which nucleus is a center line passing a center of each shorter sides.

* * * * *